US007438594B2

(12) United States Patent
Natter

(10) Patent No.: US 7,438,594 B2
(45) Date of Patent: Oct. 21, 2008

(54) ELECTRICAL PLUG-AND-SOCKET CONNECTOR

(75) Inventor: Brantley J. Natter, Brighton, MI (US)

(73) Assignee: Kostal Kontakt Systeme GmbH, Ludenscheid (DE)

( * ) Notice: Subject to any disclaimer, the term of this patent is extended or adjusted under 35 U.S.C. 154(b) by 0 days.

(21) Appl. No.: 12/075,536

(22) Filed: Mar. 12, 2008

(65) Prior Publication Data

US 2008/0227325 A1 Sep. 18, 2008

(30) Foreign Application Priority Data

Mar. 13, 2007 (DE) ..... 10 2007 011 876

(51) Int. Cl.
*H01R 13/40* (2006.01)

(52) U.S. Cl. ..... 439/595; 439/372; 439/467; 439/352

(58) Field of Classification Search ..... 439/31, 439/165, 596, 595, 372, 467, 342
See application file for complete search history.

(56) References Cited

U.S. PATENT DOCUMENTS 5,980,319 A * 11/1999 Yildiz et al. ..... 439/595
6,116,954 A * 9/2000 Ries ..... 439/596
6,305,981 B1 * 10/2001 Jetter et al. ..... 439/595
6,464,532 B1 * 10/2002 L'Abbate et al. ..... 439/467

FOREIGN PATENT DOCUMENTS

DE 019613051 C1 * 5/1997

* cited by examiner

*Primary Examiner*—Briggitte R Hammond
(74) *Attorney, Agent, or Firm*—Brooks Kushman P.C.

(57) ABSTRACT

An electrical plug-and-socket connector includes a housing having chambers for receiving contacts. Latches of the chambers hold contacts inserted in the chambers. The housing has first and second openings with pairs of the first and second openings respectively leading into the chambers. A flap attached to the housing is pivotable to either open away from the housing or close against the housing. The flap includes first projections which extend through the first openings into the chambers when the flap is closed to lock contacts held in the chambers. The flap includes second projections which extend through the second openings into the chambers when the flap is closed and when the contacts held in the chambers are positioned correctly in the chambers to engage the contacts and thereby reinforce the locking of the contacts held in the chambers.

16 Claims, 2 Drawing Sheets

ELECTRICAL PLUG-AND-SOCKET CONNECTOR

CROSS-REFERENCE TO RELATED APPLICATIONS

This application claims foreign priority benefits under 35 U.S.C. § 119(a)-(d) to DE 10 2007 011 876.9, filed Mar. 13, 2007, which is hereby incorporated by reference in its entirety.

BACKGROUND OF THE INVENTION

1. Field of the Invention

The present invention relates to an electrical plug-and-socket connector having a housing and a pivotable flap in which the housing has chambers for respectively receiving electrical plug contacts with latching elements in the chambers for holding the plug contacts therein and in which the flap has projections which penetrate into openings of the housing when the flap is pivoted toward the housing to lock the plug contacts in the chambers.

2. Background Art

DE 196 13 051 C1 describes such an electrical plug-and-socket connector. When a plug contact is introduced fully into a chamber, a locking pin attached to the flap is inserted into an opening of the housing and moves up against a shoulder of the plug contact thereby locking the plug contact in the chamber.

SUMMARY OF THE INVENTION

An object of the present invention includes an electrical plug-and-socket connector having a housing and a pivotable flap in which the housing has chambers for respectively receiving electrical plug contacts with latching elements in the chambers for holding the plug contacts therein and in which the flap has projections which penetrate into openings of the housing when the flap is pivoted toward the housing to lock the plug contacts in the chambers in which the connector may be assembled easily, provides exceptionally secure locking of the plug contacts in the chambers, and enables a directly detectable determination as to whether all of the plug contacts are correctly seated in their chambers.

In carrying out the above object and other objects, the present invention provides an electrical plug-and-socket connector having a housing and a flap. The housing has a row of chambers for respectively receiving contacts. Each chamber includes latching elements which are operable with a contact received by the chamber to hold the contact in the chamber. The housing further has a first row of first openings and a second row of second openings on a side of the housing with pairs of the first and second openings leading into respective ones of the chambers through the side of the housing. The flap is pivotably attached to the side of the housing to move between an opened position in which the flap is opened away from the side of the housing and a closed position in which the flap is closed against the side of the housing. The flap has a first row of first projections and a second row of second projections on a side of the flap which closes against the side of the housing when the flap is in the closed position. The first projections respectively extend through the first openings into the chambers when the flap is in the closed position to lock contacts held in the chambers. The second projections respectively extend through the second openings into the chambers when the flap is in the closed position and when the contacts held in the chambers are positioned correctly in the chambers to engage the contacts and thereby reinforce the locking of the contacts held in the chambers.

In accordance with embodiments of the present invention, an electrical plug-and-socket connector includes a housing and a flap pivotably attached to the housing. The housing has a row of chambers for respectively receiving electrical plug contacts. The housing further has a first row of first openings and a second row of second openings. The chambers are respectively associated with pairs of the first and second openings. Latching elements are in the chambers for holding the plug contacts therein. The flap has a first row of first projections which respectively extend into the first openings of the housing when the flap is pivoted against the housing to lock the plug contacts in the chambers. The flap has a second row of second projections which respectively extend into the second openings of the housing when the flap is pivoted against the housing and the plug contacts are correctly positioned in the chambers. The second projections reinforce the locking of the plug contacts in the chambers when the second projections extend into the second openings.

The second row of second projections are alongside the first row of first projections on the side of the flap which faces the housing when the flap is closed against the housing. The projections are molded to the flap. The second projections cannot be pushed through the second openings of the housing when at least one of the plug contacts is incorrectly positioned in the chambers. In this case, the flap cannot be fully closed against the housing whereby the incorrect positioning of the plug contacts (as a group) in the chambers can immediately be recognized. This can be achieved advantageously if the second projections can only be admitted through the second openings of the housing against specific sections of the plug contacts while being blocked from extending through the second openings by the remaining sections of the plug contacts. For instance, the specific section of a plug contact is the narrowest section (e.g., the crimping section) of the plug contact. In general, each second projection is formed to support the crimping section of a plug contact when the second projection is inserted into a second opening of the housing. As such, each second projection is advantageously formed so that they each support a section of a plug contact when they are inserted into the respective second opening of the housing and thereby also secure the plug contact inside the chamber.

Each second projection can also be inserted into the respective second opening of the housing when no plug contact is present in the chamber. This would make it possible, for example, to provide different plug contact parts equipped with plug contacts for different device variants outfitted with plug contacts.

The verification function enabled by the second projections thereby detects incorrectly positioned plug contacts, but does not distinguish between plug contacts that are correctly positioned and those that are not present. However, the latter is not a problem because missing plug contacts can be immediately recognized in contrast to the case of incorrectly positioned plug contacts.

In an embodiment, all of the first and second projections are formed on a single flap. This enables the locking and position checking of all plug contacts to be carried out in a single operation. In the event that at least one of the plug contacts is not located in the correct latching position inside a chamber of the housing, the flap cannot be shut on the housing so that an incorrectly positioned plug contact can be readily detected.

The above features, and other features and advantages of the present invention as readily apparent from the following detailed descriptions thereof when taken in connection with the accompanying drawings.

DETAILED DESCRIPTION OF THE PREFERRED EMBODIMENT(S)

Figure 1:
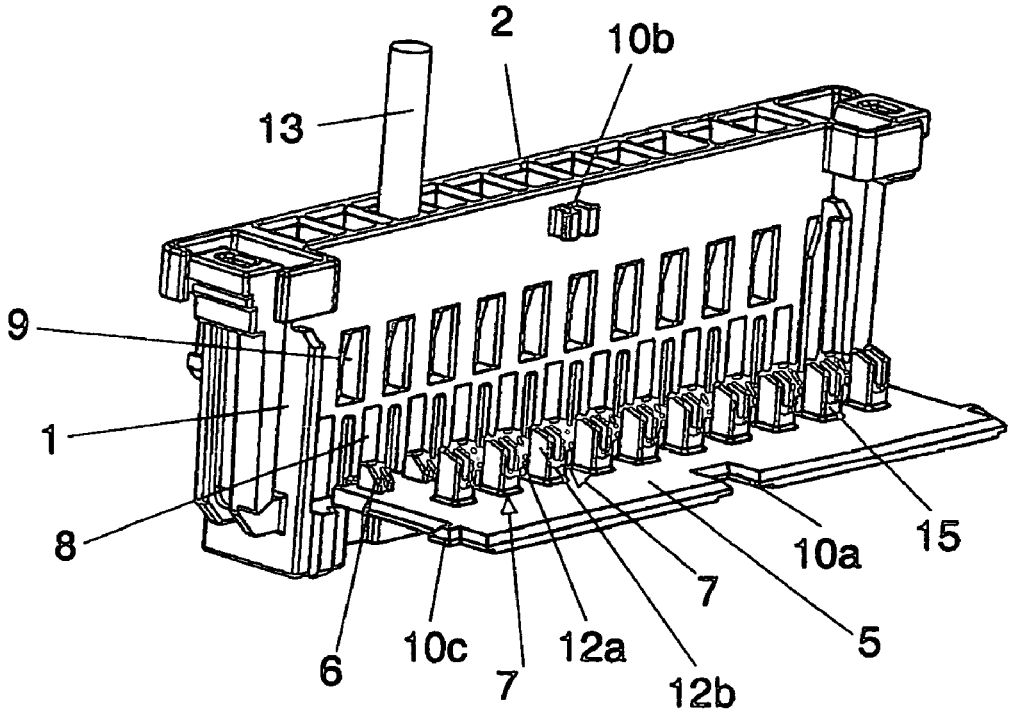
FIG. 1 illustrates a perspective view of an electrical plug-and-socket connector in accordance with an embodiment of the present invention in which the flap of the connector is opened relative to the housing of the connector.

Referring now to FIG. 1, a perspective view of an electrical plug-and-socket connector in accordance with an embodiment of the present invention is shown. The connector includes a housing 1 and a flap 5. Housing 1 includes a plurality of receptacle chambers 2 which are arranged side-by-side in a longitudinal direction. Chambers 2 are for receiving respective electrical plug contacts. The plug contacts are individually inserted into chambers 2 through one end of chambers 2 to be received therein. Flap 5 is pivotably attached to housing 1. Flap 5 is pivotable between an opened position (shown in FIGS. 1 and 2) in which flap 5 is opened away from housing 1 and a closed position (shown in FIGS. 3, 4, and 5) in which flap 5 is closed against housing 1.

In FIGS. 1, 2, 3, 4, and 5, for simplicity, only one of chambers 2 is shown with a plug contact 3. A connector wire 13 extends into chamber 2. Connector wire 13 is connected within chamber 2 to plug contact 3 inserted into chamber 2. In particular, plug contact 3 has a crimping region 14 by which connector wire 13 is mechanically and electrically attached. It is to be appreciated that in actual implementations, all or at least a number of chambers 2 respectively have plug contacts 3 inserted therein with such plug contacts 3 being connected to respective connector wires 13 extending into respective chambers 2.

Figure 2:
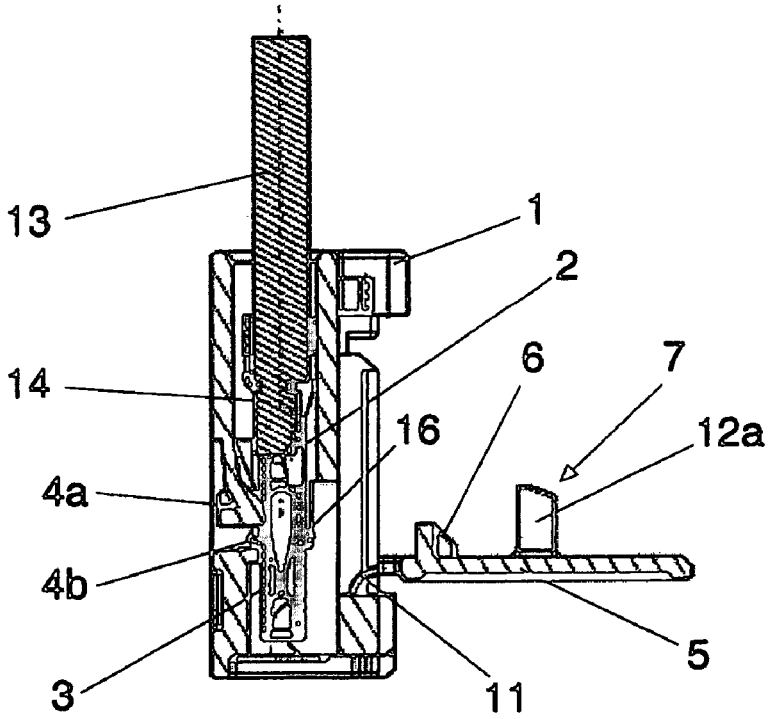
FIG. 2 illustrates a cross-sectional view of the connector as shown in FIG. 1.

Referring now to FIG. 2, with continual reference to FIG. 1, a cross-sectional view of the connector as shown in FIG. 1 is shown. Housing 1 includes a film hinge 11 molded integrally thereon. Film hinge 1 pivotably attaches flap 5 to housing 1. Flap 5 includes a first set of projections 6 and a second set of projections 7 molded thereon on the side of flap 5 facing toward housing 1. First projections 6 are separately arranged from one another and extend across the side of flap 5 facing toward housing 1 in a first row along the longitudinal direction. Second projections 7 are separately arranged from one another and extend across the side of flap 5 facing toward housing 1 in a second row along the longitudinal direction. The first row of first projections 6 lie closest to film hinge 11 than the second row of second projections 7. First and second projections 6, 7 are aligned with one another in a lateral direction across the side of flap 5 facing toward housing 1. Each adjacent pair of first and second projections 6, 7 is associated with a respective chamber 2 of housing 1. That is, for every chamber 2 there is an associated pair of first and second projections 6, 7. Each first projection 6 has the shape of a relatively flat lug. Each second projection 7 includes a pair of tabs 12*a*, 12*b* and a common socket 15. Tabs 12*a*, 12*b* project outwards from common socket 15 and perpendicularly extend in parallel from the side of flap 5 facing toward housing 1. Tabs 12*a*, 12*b* extend further out from the side of flap 5 facing toward housing 1 than lug-shaped first projections 6.

Housing 1 includes first openings 8 and second openings 9. First openings 8 are separately arranged from one another and extend across the side of housing 1 facing flap 5 in a first row along the longitudinal direction. Second openings 9 are separately arranged from one another and extend across the side of housing 1 facing flap 5 in a second row along the longitudinal direction. The first row of first openings 8 lie closest to film hinge 11 than the second row of second openings 9. First and second openings 8, 9 are aligned with one another in a lateral direction across the side of housing 1 facing toward flap 5. Each adjacent pair of first and second openings 8, 9 is associated with a respective chamber 2 of housing 1 and the first and second projections 6, 7 which are associated with the respective chamber 2 of housing 1. That is, for every chamber 2 there is an associated pair of first and second openings 8, 9 and an associated pair of first and second projections 6, 7. When flap 5 is pivoted closed against housing 1, first and second projections 6, 7 respectively extend through first and second openings 8, 9 into chambers 2 to lock plug contacts 3 therein.

Figure 3:
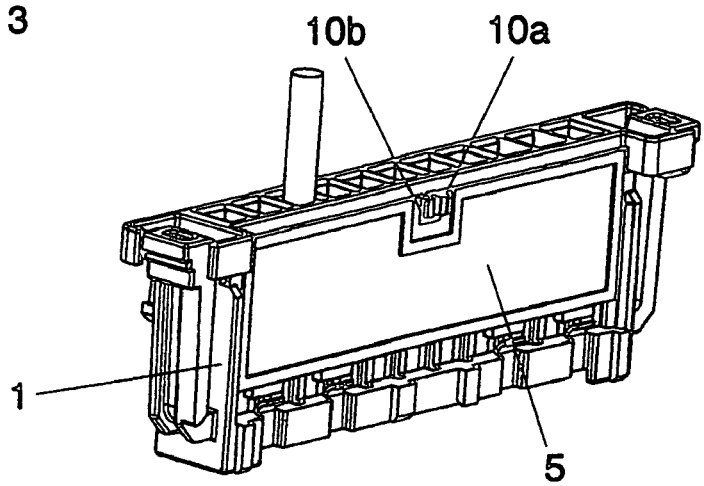
FIG. 3 illustrates a perspective view of the connector in which the flap of the connector is closed relative to the housing of the connector.
Figure 4:
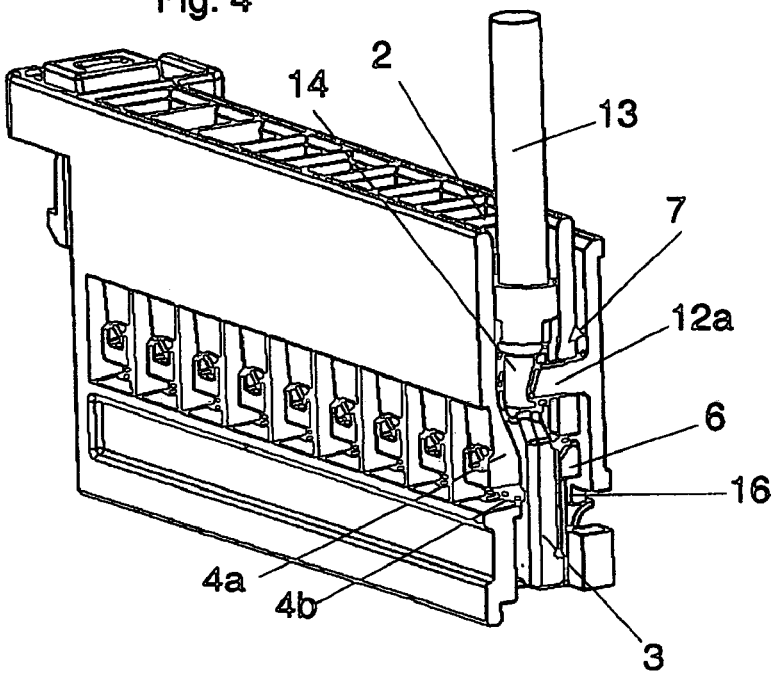
FIG. 4 illustrates a sectional view of the connector as shown in FIG. 3.
Figure 5:
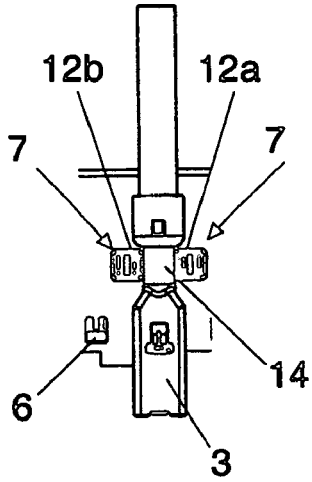
FIG. 5 illustrates a detailed view of the connector as shown in FIG. 4.

Referring now to FIGS. 3, 4, and 5, with continual reference to FIGS. 1 and 2, perspective, sectional, and detailed views of the connector are respectively shown. As indicated above, FIGS. 1 and 2 each illustrate views of the connector when flap 5 is pivoted opened from housing 1. FIGS. 3, 4, and 5 each illustrate views of the connector when flap 5 is pivoted closed against housing 1. Flap 5 is held in its closed position by a snap-in locking device having parts 10*a*, 10*b* respectively on the side of housing 1 facing flap 5 and the side of flap 5 facing housing 1.

Each chamber 2 includes a pair of latching elements 4*a*, 4*b* therein. Latching elements 4*a*, 4*b* are operable with one another to hold a plug contact 3 received in chamber 2. Latching element 4*a* is an elastic locking arm formed integrally on a wall of chamber 2. Latching element 4*b* is an exposed latching segment which displaces locking arm 4*a* during insertion of plug contact 3 into chamber 2 and latches behind locking arm 4*a*. Plug contact 3 is thereby held by locking arm 4*a* and latching segment 4*b* in chamber 2. Latching elements 4*a*, 4*b* provide a primary lock for holding plug contact 3 in chamber 2.

In order to prevent plug contact 3 from being separated from chamber 2, the connector is configured to provide an additional secondary lock which produces a form-fit locking of plug contact 3 in chamber 2. For this purpose, when flap 5 is pivoted closed against housing 1, first projection 6 on flap 5 reaches behind a second latching segment 16 of chamber 2 and thereby locks plug contact 3 in chamber 2 by a form-fit.

As plug contacts 3 inserted into chambers 2 are to be locked in chambers 2 by first projections 6 at the same time when flap 5 is closed against housing 1, it must be assured that plug contacts 3 are inserted correctly into chambers 2 prior to flap 5 being closed. Second projections 7 provide this assurance. As indicted above, each second projection 7 includes two parallel tabs 12*a*, 12*b* that project perpendicularly from flap 5. Tabs 12*a*, 12*b* exhibit elastic spring properties with respect to lateral deflections. Second projections 7 penetrate second openings 9 of housing 1 when flap 5 is closed and thereby reach far into chambers 2.

When all of plug contacts 3 are located in the correct position inside chambers 2, tabs 12*a*, 12*b* of second projections 7 move up against crimping regions 14 of plug contacts 3. As is shown by FIG. 5, crimping region 14 of a plug contact 3 is thereby surrounded by tabs 12*a*, 12*b* of the associated second projection 7 and is supported by tabs 12*a*, 12*b* under spring pressure.

As also shown by FIG. 5, crimping region 14 is the narrowest section of plug contact 3. If plug contact 3 is not positioned correctly in chamber 2 such that plug contact 3 is thus inserted to far or not far enough in chamber 2, then tabs 12*a*, 12*b* of second projection 7 strike a part of plug contact 3 which thereby prevents full closure of flap 5 against housing 1.

By being able to close flap 5 against housing 1, the correct seating of plug contacts 3 in chambers 2 is thereby checked. In the positive case, the secondary locking of plug contacts 3 in chambers 2 by first projections 6 is carried out. Further, tabs 12*a*, 12*b* of second projections 7 lying against plug contacts 3 when flap 5 is closed against housing 1 produce an additional locking action and thus a tertiary locking of plug contacts 3 in chambers 2.

REFERENCE NUMBERS

1 Housing
2 Receptacle chamber
3 Plug contact
4*a* Locking arm
4*b* Latching segment
5 Flap
6 First projection
7 Second projection
8 First opening
9 Second opening
10*a* Snap-in locking device
10*b* Snap-in locking device
10*c* Latching lug
11 Film hinge
12*a* Tab
12*b* Tab
13 Connector wire
14 Crimping region
15 Socket
16 Latching segment While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. An electrical plug-and-socket connector comprising:

a housing having a row of chambers for respectively receiving contacts, wherein each chamber includes latching elements which are operable with a contact received by the chamber to hold the contact in the chamber, the housing further having a first row of first openings and a second row of second openings on a side of the housing with pairs of the first and second openings leading into respective ones of the chambers through the side of the housing; and a flap pivotably attached to the side of the housing to move between an opened position in which the flap is opened away from the side of the housing and a closed position in which the flap is closed against the side of the housing, the flap having a first row of first projections and a second row of second projections on a side of the flap which closes against the side of the housing when the flap is in the closed position;

wherein the first projections respectively extend through the first openings into the chambers when the flap is in the closed position to lock contacts held in the chambers;

wherein the second projections respectively extend through the second openings into the chambers when the flap is in the closed position and when the contacts held in the chambers are positioned correctly in the chambers to engage the contacts and thereby reinforce the locking of the contacts held in the chambers.

2. The connector of claim 1 wherein:

the projections are molded to the flap.

3. The connector of claim 1 wherein:

the second row of second projections are alongside the first row of first projections on the side of the flap which faces the housing when the flap is closed against the housing.

4. The connector of claim 1 wherein:

the second projections are operable with contacts held in the chambers to prevent the flap from moving to the closed position when one of the contacts is incorrectly positioned in a chamber.

5. The connector of claim 4 wherein:

the second projections cannot be pushed through the second openings when one of the contacts is incorrectly positioned in a chamber thereby preventing the flap from moving to the closed position.

6. The connector of claim 4 wherein each plug contact has a relatively narrow crimping section between relatively larger remaining sections, wherein:

the second projections extend through the second openings when the contacts held in the chambers are correctly positioned in the chambers such that the second projections respectively engage the narrow crimping section of respective contacts held in the chambers;

wherein the second projections are prevented from extending through the second openings when a contact held in a chamber is incorrectly positioned in the chamber such that a second projection is blocked by the contact by engaging a section of the contact other than the narrow crimping section of the contact.

7. The connector of claim 1 wherein:

each contact is a socket contact or a plug contact.

8. The connector of claim 1 wherein:

each second projection includes a pair of tabs which are configured to engage a crimping section of a contact on opposite sides when the second projection engages the contact.

9. The connector of claim 1 wherein:

each second projection has a shape which is configured to engage a crimping section of a contact when the second projection engages the contact.

10. The connector of claim 1 wherein:

the second projections project farther from the side of the flap than the first projections.

11. The connector of claim 1 wherein:

each contact includes a crimping region, wherein a connector wire inserted into a chamber is crimped to the crimping region of the contact held in the chamber.

12. The connector of claim 1 wherein:

the housing further includes a film hinge which pivotably attaches the flap to the side of the housing.

13. The connector of claim 1 wherein:

each chamber is a receptacle chamber.

14. The connector of claim 1 wherein:

each contact is an electrical contact.

15. The connector of claim 1 wherein:

the latching elements of a chamber include an elastic locking arm and a locking segment.

16. The connector of claim 1 wherein:

each chamber further includes a latching segment, wherein the first projections engage the latching segments of the chambers to lock the contacts held in the chambers.

* * * * *